US005119611A

United States Patent [19]

Goertz

[11] Patent Number: 5,119,611

[45] Date of Patent: * Jun. 9, 1992

[54] UNITARY FOAM GRAVEL ROOF COVERING

[76] Inventor: Alois Goertz, 4 Retford Ave., Cranford, N.J. 07016

[ * ] Notice: The portion of the term of this patent subsequent to Aug. 14, 2007 has been disclaimed.

[21] Appl. No.: 516,715

[22] Filed: Apr. 30, 1990

Related U.S. Application Data

[63] Continuation-in-part of Ser. No. 258,624, Oct. 17, 1988, Pat. No. 4,947,603, which is a continuation-in-part of Ser. No. 97,059, Sep. 16, 1987, abandoned.

[51] Int. Cl.[5] ..... E04B 7/00; E04B 5/00

[52] U.S. Cl. ..... 52/309.4; 52/408

[58] Field of Search ..... 52/309.4, 309.8, 309.9, 52/526, 745-746, 2 E, 408

[56] References Cited

U.S. PATENT DOCUMENTS 4,947,603 8/1990 Goertz ..... 52/309.4

FOREIGN PATENT DOCUMENTS 2532100 2/1977 Fed. Rep. of Germany ..... 52/309.8

*Primary Examiner*—David A. Scherbel
*Assistant Examiner*—Michele A. Van Patten
*Attorney, Agent, or Firm*—Omri M. Behr

[57] ABSTRACT

A sprayed closed cell foam roof is prepared by applying the foam directly to the roof deck and layering the foam with sufficient gravel to prevent ultraviolet light deterioration of the foam. The roof is devoid of the waterproof layer conventional in foam roofs that leads to leaks and other failures common to such roofs.

15 Claims, 2 Drawing Sheets

UNITARY FOAM GRAVEL ROOF COVERING

RELATED APPLICATIONS

This application is a continuation-in-part of applicant's co-pending application Ser. No. 258,624, filed Oct. 17, 1988, now U.S. Pat. No. 4,947,603 which is a continuation in part of Ser. No. 097,059, filed Sep. 16, 1987, now abandoned.

BACKGROUND OF THE INVENTION

Sprayed, closed-cell foam roofs originated in the 1950s in the wake of the development of the foams after World War II. The foam is typically made of two components which, when mixed together, give off an exothermic reaction. This causes the mixture to expand, trapping Freon in the cells and forming a material with insulating properties superior to any other commercially available insulation. (See RSI, June 1982, pp. 44–48).

The sprayed-in-place feature allows a contractor to provide an essentially seamless roof. Typically, the foam layer is sprayed onto the roof deck, coated with a waterproof layer and then covered with a layer of gravel. See for instance, the North Carolina Foam Industries, Inc. information sheet on Graveledfoam TM Roof Systems.

Numerous types of water impermeable coatings have been utilized throughout the years in an effort to prevent the sprayed foam layer from becoming water-logged, thus, resulting in leaks or other roof failure. Moore and Kashiwagi, (30th Annual Polyurethane Technical/Marketing Conference, Oct. 15–17, 1986, pp. 93–98), lists coatings of silicone, silicone and acrylic, asphalt and urethane. The roofing industry's position has always been that the foam is permeable to water and thus, it is necessary to protect it with a water-impermeable coating.

Ultraviolet degradation, heavy traffic, or movement of equipment across foam roofing will cause damage to the foam surface in the form of open or broken cells. Water will infiltrate into such cells. A water-impermeable coating prevents infiltration of water into such cells providing that the coating is totally intact and perfectly adhered. Any break in the coating would allow water to enter and flow laterally between the coating and the damaged foam surface. The ultimate result is that the foam becomes water-logged and the roof fails.

Additionally, there is a vapor drive from the inside of a building to the outside. When the roof deck has the insulating foam on top of it and the waterproof coating on top of the foam, the water vapor diffuses through the foam and condenses on the underside of the coating. Thus, a potentially destructive layer of water forms between the foam and its coating. Again, the ultimate result is that the foam becomes water-logged and the roof fails.

DESCRIPTION OF THE PRIOR ART

Despite the theory of water vapor drive, the requirement of a waterproof layer is found in essentially all roofing systems. For instance, U.S. Pat. No. 4,492,064 discloses a roof comprising a plurality of closed cell thermal insulation foam panels, which are disposed over a water impermeable barrier layer. U.S. Pat. No. 4,396,686 concerns a roof whose insulating layer comprises expanded polyurethane which is covered first by a zinc plated steel sheet and then by a bituminous coating. The U.S. Pat. No. 3,411,256 discloses a thermal insulating layer adhered to a water impermeable layer below it. Another U.S. Pat. No. 3,266,206, utilizes urethane foam layers covered by additional layers of waterproofing material which rest on waterproof sheets. Other roof layers and materials utilizing a foam layer all contain some form of vapor barrier; see, for instance, U.S. Pat. Nos. 3,763,614 (thermal insulation placed over water barrier layer); 3,619,343 (roof product of polyolefin coating for weather protection); 3,965,633 (waterproof wearing surface on exterior of foam insulation board); 4,274,238 (drainage board above a water barrier layer and below a thermal insulation layer) 4,651,494 (interlocking foam blocks over a waterproof vapor barrier).

In RSI, February, 1987, pp 92–100, the authors define a polyurethane foam (PUF) roof system as made up of three components: PUF, a cover and a vapor barrier. The purpose of the PUF is to foam a closed cell waterproofing barrier to protect the facility against water leakage and to provide insulation. The typical problems identified with PUF are: 1) condensation of moisture in the top layers of the PUF; 2) freezing of moisture-laden PUF cells, causing a loss of insulation, structural and waterproofing capability; 3) improper cell formation; 4) disbonding of the PUF layers due to inadequate thicknesses, presence of moisture between passes or burnt PUF surfaces; and 5) improper PUF structural capability.

The second required component of the PUF roof system is the cover. Its requirements are that it protects the PUF from ultraviolet rays and distribute point loadings out over a wide area not to exceed the structural requirements on the PUF.

The last compound of the PUF roof system is the vapor barrier. The purpose of the vapor barrier is to prevent moisture from entering the PUF from the inside of a structure.

SUMMARY OF THE INVENTION

It is an object of the invention to provide a sprayed closed cell foam roof which allows the free passage of water vapor to obviate the problems caused by entrapment of water vapor.

It is a still further object of this invention to provide a sprayed closed cell foam roof of which at least a segment is devoid of a waterproof layer conventional in foam roofs.

A still further object of the present invention is to provide a method of preparing an unbroken layer sprayed foam roof layer on an air permeable roof deck of which at least a segment, though preferably the entire surface is devoid of a water and water vapor impermeable layer and which lacks the problems associated with conventionally prepared sprayed foam roofs.

The present invention concerns a roof comprising roof deck, at least a segment of which is air and water vapor permeable, directly supporting an unbroken sprayed closed cell foam material overlayered with gravel in an amount sufficient to prevent ultraviolet light deterioration of the foam, and the method of preparing same.

The key to the present invention is the surprising finding that better results are obtained with a roof structure which does not contain a water vapor impermeable layer between the structural support of the roof and the foam layer. The structural support or roof deck is generally made of plywood or similar materials and is permeable to water vapor, either through cracks between the sheets of plywood or through the pores of the wood itself.

It should be understood that in heated buildings water vapor is driven outwardly and if it hits a water vapor impermeable layer which is warm on the lower surface and cold on the upper surface, condensation will occur on the lower surface of this layer which ultimately will cause damage to either the roof deck or to ceilings under the roof deck.

As is clearly shown by the Prior Art the presence of such a water vapor impermeable layer has always been considered essential to maintain the integrity of the roof against liquid impaction from the outside i.e., by rain on the top surface of the roof. However sprayed foam is impermeable to liquid water and yet, permeable to water vapor. Thus, water vapor can be driven outwardly from the inside of the building without the condensation problems set forth above.

While it is desirable, for the full achievement of the improvement of this invention to operate on a roof deck entirely devoid of vapor barriers, the invention is still operative with roofs which still partially bear vapor barriers. Thus provided the whole roof is covered by foam to provide water proofing, roofs wherein only a segment of the deck is devoid of a vapor barrier but the upper surface of the deck at said permeable segment is in direct contact with the lower surface of the foam layer are still within its scope.

DESCRIPTION OF THE PREFERRED EMBODIMENTS

Figure 1:
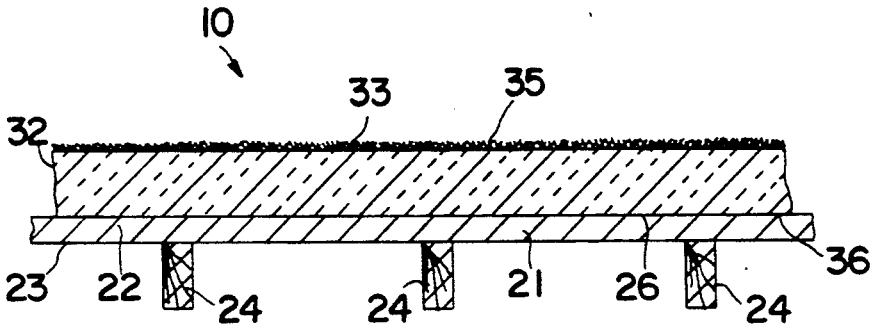
FIG. 1 is a cross sectional view of a roof of the present invention.

The roof of the present invention is prepared by applying and affixing directly to a roof deck at least a segment of which, preferably its entire surface is air and water vapor permeable, a sprayed closed cell foam material covering the entire roof surface and directly applying thereto a layer of gravel sufficient to prevent ultraviolet light deterioration of the foam. The resultant roof is thus devoid of any waterproof vapor barrier such as is conventionally found in typical roof systems.

The sprayed closed cell foam material utilized in the present invention may be any of the conventionally available foams. Such foams are prepared by mixing two components, which chemically react to form the foamed material. Numerous such materials are available, typically they are combined of A-isocyanate and B-polyol, which react to give polyurethane foam. By varying the amounts of each component, foams of differing densities can be obtained. Typically, for roofing structures, a density of from about 25 to 80 $Kg/m^3$., suitably 25–55 $Kg/m^3$. is desired in the foam product. Lesser densities have insufficient mechanical strength, while the use of higher densities is wasteful.

The sprayed closed cell foam material is applied to the roof deck utilizing conventional spraying equipment. For standard roof structures, the foam is applied to the roof deck to a depth of 2.5 cm or greater, with the usual finished depth being about 2.5–4 cm. Typically, the foam is applied in layers of about 2.5–4 cm, so that when a depth of greater than 2.5 cm is required, more than one layer of foam is applied to the roof, suitably to a depth of 8–12 cm. There is no upper limit, but greater numbers of layers are wasteful.

The foaming action depends upon the ambient temperature. Most commercial mixtures are formulated with Freons which are set to produce satisfactory foams at ambient temperatures of between about 15° to 20° C. Operation outside these ranges which require use of Freon formulations which are commercially available and known to those skilled in the art.

Commercial Formulations include:

PDL 110-2 and PDL 106, both manufactured by Polymer Development Laboratories, Dickson Street, Newburgh, N.Y. 12550. The former is a Uniform Building Code (UBC) Class 1 foam, available in 32, 40 and 48 $Kg/m^3$. formulations The latter is a UBC Class II foam. It is available in 24 through 48 $Kg/m^3$. formulations and is sold in summer and winter grades for applications between 15° and 38° C.

There may also be used NFCI spray systems 362-85 and 225 manufactured by North Carolina Foam Industries, Inc., P.O. Box 1528, Mount Airy, N.C. 27030. The former spray provides a core density of 32 $Kg/m^3$., the latter of 30.4 $Kg/m^3$. A further foam system is the UTC 025 spray foam system made by Urethane Technology Co. Inc., Dickson Street, Newburgh, N.Y. 12550. The system offers in place densities of 35.2, 40 and 96 $Kg/m^3$. for their foams 025-2, 025-2.5 and 025-3

In the case of new roofing, the foam layer is applied to the air and water vapor permeable roof deck according to the foam manufacturer's directions. In the usual case this means that the roof deck surface must be free of oil, grease, rust and dirt. All surfaces must be dry and free dew, frost or other moisture. In the case where there is an existing roof, it is preferable that the old covering be stripped down to the water vapor permeable roof deck. If the old covering is only partially removed to provide a vapor permeable segment, all the surfaces must be cleaned of loose aggregate and debris prior to application of the foam layer.

After the foam layer is in place, as layer of gravel sufficient to prevent ultraviolet light deterioration of the foam is applied directly to the foam layer. Generally, the amount of gravel applied is about 10–25 $Kg/m^2$. of foam roof surface, with 20 $Kg/m^2$. being particularly preferred. The type and size of gravel is not critical to the invention, but that conforming to the American Society for Testing Materials, D 1863-83, Size Number 7, is particularly suitable for the preparation of roofs, according to this invention.

Thus, a roof prepared according to the present invention consists essentially of a roof deck having at least an air and water vapor permeable segment, directly supporting a unitary, unbroken layer of closed cell foam material covering the entire roof surface, layered, with gravel in an amount sufficient to prevent ultraviolet light deterioration of the foam.

Since the foam itself is waterproof, it needs only to be protected from the ultraviolet light to maintain its structural integrity. Since the vapor drive from within the building is allowed to naturally flow out through the sprayed foam, there is no condensation to water-log the foam.

in FIG. 1, the roof 10 comprises the roof deck 21 laid on beams 24. On upper surface 22 of deck 21 is sprayed foam layer 32 with its bottom surface 36 in direct contact therewith. Gravel layer 35 is placed on upper surface 33 of foam layer 32.

Figure 2:
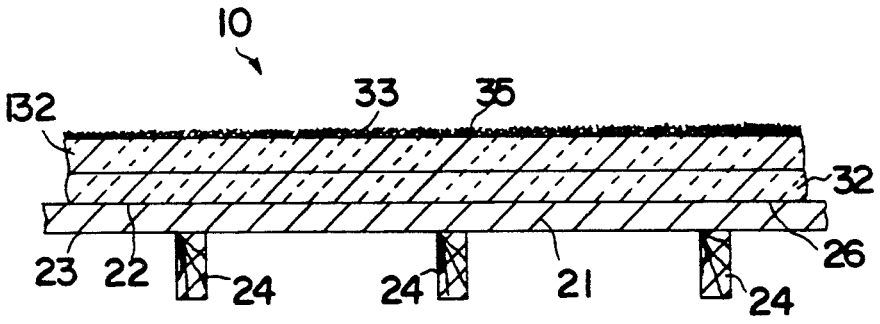
FIG. 2 is a cross-sectional view of a roof of the present invention in a further embodiment showing two layers of foam laid upon each other.

FIG. 2 is a further embodiment of the roof shown in FIG. 1 showing additionally however a second foamed layer 132 placed upon the first foam layer 32.

Figure 3:
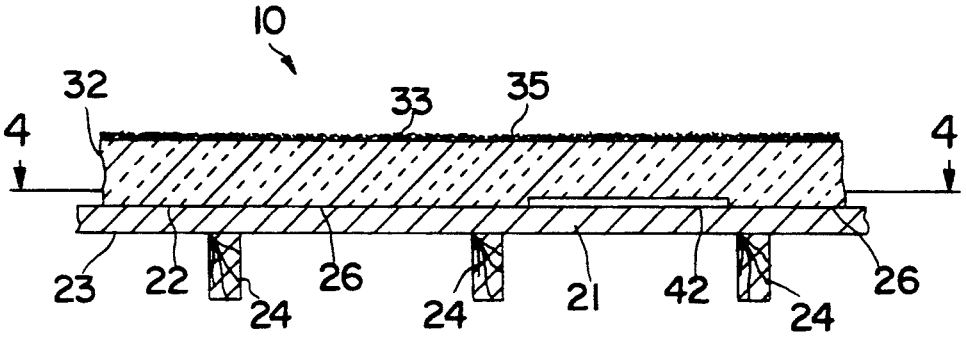
FIG. 3 is a cross sectional view of a roof of the present invention wherein a portion of the old water vapor impermeable cover is still in place.
Figure 4:
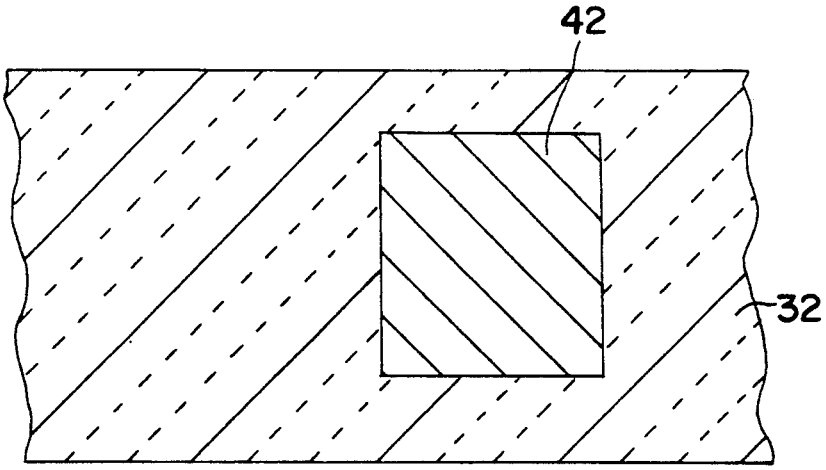
FIG. 4 is a plan view of FIG. 3 taken at 4—4, of a roof of the present invention wherein a portion of the old water vapor impermeable cover is still in place.

FIG. 3 is similar to FIG. 1, but shows a portion of old, water vapor impermeable covering 42, still in place with the vicinal lower surface of foam layer 32 in direct contact with the upper surface 22 of the water vapor permeable segment 26 of deck 21. The permeable area 26 is that illustrated in FIG. 4 as that portion of the deck 21 underlying the there illustrated portion of foam 32 surrounding the old covering 42.

The following example describes in detail a roof of the present invention and the method of preparing it. Many modifications, both of materials and methods, can be made without departing from the spirit and scope of this invention.

EXAMPLE I

To a wood roof deck, dried and cleaned of debris, is applied a 4 cm layers of North Carolina Foam Industries, Inc., NCFI 584-2.5 (a two-component rigid urethane foam which, when mixed and sprayed in place according to manufacturer's directions, produces a 40 $Kg/m^3$. core density). After the foam is applied, gravel meeting ASTMD 1863-83, Size Number 7, is applied at a rate of 20 $Kg/m^2$. of foam surface.

In accordance with the above procedure, a second 4 cm layer is applied after the first layer has set but before application of the gravel.

EXAMPLE II

An old roof covering a wood roof deck with felt and asphalt is inspected and found to be unsound over 25% of its surface. This unsound segment is excised and the entire roof derived and cleaned of debris. Then there is applied to the entire roof, a 4 cm layer of North Carolina Foam Industries, Inc., NFCI 584-2.5 (a two-component rigid urethane foam which, when mixed and sprayed in place according to manufacturer's directions, produces a 40 $Kg/m^3$. core density). After the foam is applied, gravel meeting ASTMD 1863-83, Size Number 7, is applied at a rate of 20 $Kg/m^2$. of foam surface.

I claim:

1. A roof structure comprising:

a roof deck having an upper and a lower surface and having an air and water vapor permeable segment, all segments of said deck supporting and being covered by an unbroken layer of sprayed closed cell foam material, the vicinal lower surface of said foam layer being in direct contact with the upper surface of said permeable segment and the upper surface of said foam layer being layered with gravel in an amount sufficient to prevent ultraviolet light deterioration of the foam.

2. The structure of claim 1 wherein the area of said permeable segment is less than the entire surface area of the said deck.

3. The structure of claim 1 wherein the area of said permeable segment is equal to the entire surface area of the said deck.

4. The roof structure according to claim 1 wherein the sprayed closed cell foam material is provided as layers of a depth of 2.5 cm or greater per layer.

5. The roof structure according to claim 1 wherein the sprayed closed cell foam material is layered to a depth of about 8–12 cm.

6. The roof structure according to claim 1 wherein the gravel layer is about 10–25 $Kg/m^2$. of foam roof surface.

7. The roof structure according to claim 6 wherein the gravel layer is about 20 $Kg/m^2$. of foam roof surface.

8. The roof structure according to claim 1 wherein the sprayed closed cell foam is of the polyurethane type.

9. A method of preparing a roof structure comprising the steps of:

applying and affixing to all segments of the upper surface of a roof deck having an air and water vapor permeable segment, an unbroken layer of sprayed closed cell foam material, the vicinal lower surface of said foam material being in direct contact with said permeable segment and directly applying upon said foam layer, a layer of gravel sufficient to prevent ultraviolet light deterioration of the foam.

10. The method of claim 9 wherein the area of said permeable segment is less than the entire surface area of the said deck.

11. The method of claim 9 wherein the area of said permeable segment is equal to the entire surface area of the said deck.

12. The method according to claim 9 wherein the sprayed closed cell foam is applied in multiple layers to a total depth of about 8–12 cm.

13. The method according to claim 9 wherein the gravel layer is applied at a rate of about 10–25 $Kg/m^2$. of foam roof surface.

14. The method according to claim 9 wherein the gravel layer is applied at a rate of about 20 $Kg/m^2$. of foam roof surface.

15. The method according to claim 9 wherein the sprayed closed cell foam is of the polyurethane type.

* * * * *